US008633366B2

(12) United States Patent
Reddick

(10) Patent No.: US 8,633,366 B2
(45) Date of Patent: Jan. 21, 2014

(54) DRUM PEDAL COVER

(76) Inventor: Jared B. Reddick, Dunnellon, FL (US)

( * ) Notice: Subject to any disclaimer, the term of this patent is extended or adjusted under 35 U.S.C. 154(b) by 22 days.

(21) Appl. No.: 13/366,275

(22) Filed: Feb. 4, 2012

(65) Prior Publication Data

US 2013/0199355 A1 Aug. 8, 2013

(51) Int. Cl.
*G10D 13/02* (2006.01)

(52) U.S. Cl.
USPC ..... 84/422.1

(58) Field of Classification Search
USPC ..... 84/411 R, 421, 453, 229, 357, 358, 366, 84/353
See application file for complete search history.

(56) References Cited

U.S. PATENT DOCUMENTS 6,096,957 A * 8/2000 Andersen ..... 84/422.1

* cited by examiner

*Primary Examiner* — Kimberly Lockett

(57) ABSTRACT

A drum pedal cover for attachment to a drum pedal surface is hereby disclosed. Single or multiple layers of padded foam material are employed, which are attached to the drum pedal surface. The padded material is used to reduce shock and provide comfort to the user during drumming. The drum pedal cover is attached to the drum pedal surface by employing the use of several strap assemblies, which are woven through apertures in the drum pedal cover. The strap assembly winds underneath the drum pedal's surface and is attached from the underside of the drum pedal. The strap assembly enables the user to rapidly employ and deploy the invention.

1 Claim, 5 Drawing Sheets

DRUM PEDAL COVER

CROSS REFERENCE TO RELATED APPLICATIONS

Not Applicable

STATEMENT REGARDING FEDERALLY SPONSORED RESEARCH OR DEVELOPMENT

Not Applicable

REFERENCE TO SEQUENCE LISTING

Not Applicable

BACKGROUND OF THE INVENTION

1. Field of the Invention

This invention generally lies within the realm of musical instrument accessories. Specifically, those pertaining to accessories related to drums and percussion instruments. Although, the product could be used with virtually any instrument, that requires the use of a foot pedal to play. However, this invention is designed to allow a person to play the instrument without shoes and or socks and experience comfort during use. This product is also designed to reduce shock and excessive exertion of the foot and ankle, especially while performing or practicing for extended periods of time.

2. Description of Prior Art

U.S. Pat. No. 4,819,536 to Lombardi discloses a drum pedal that is typical of other drum pedals used in the art. This and other similar pedals normally have an abrasive surface, in which the user has to negotiate. These pedal surfaces have always been concerned with the traction of the foot during a performance, ensuring that the foot would not slide off the pedal. Most of these style pedals are made of metal of some sort and could be considered harsh to someone that has a preference to playing without footwear or other protection for their feet. U.S. Pat. No. 6,710,237 to Adams discloses a drum pedal for the enhanced mating of a drummer's foot. This foot pad enhancement is primarily concerned with amplifying the "sweet spot" of a drum pedal with protrusions on its surface. It secondarily, focuses on the traction of the foot on the pedal during a performance, as well as limited shock reduction. This patent also details a product that is comprised of a plurality of layers of foam material and is attached to a drum pedal by an adhesive means.

BRIEF SUMMARY OF THE INVENTION

The drum pedal cover consists of a ½ inch to 1 inch thick single layer of foam rubber or other similar substance, which is generally similar in shape to that of a drum pedal surface. The single layer of foam rubber material generally covers the entire top surface of the drum pedal. The invention has 6 apertures within its perimeter, which are located on top, middle and lower portions of the drum pedal cover. There are 2 apertures located on each of the top, middle, and lower sections of the pedal cover. The single layer of foam is attached to the drum pedal surface by employing the use of 3 flexible fabric strap assemblies. The 3 strap assemblies are woven throughout the apertures in the drum pedal cover. The strap assembly is wrapped underneath the drum pedal to securely fasten the pedal cover to the main pedal surface.

Drum pedal surfaces, like the ones listed in prior art, provide very little no or comfort for the barefoot drummer. The drum pedal cover invention provides tremendous support due to the thickness and rigidity of foam rubber material being used. This not only solves the problem of shock reduction, it also achieves this with a means of quick attachment and detachment, through the use of the strap assembly.

Many drummers and/or percussionists prefer to play barefooted, if possible, because of the increased feel that they are able to obtain with the instrument. Especially with respect to timing, since it is of utmost importance with this type of musical instrument. However, the effects of repetitive contact between a bare foot and an uncovered strip of metal are quite noticeable. The two major affected areas are the ball and heel of the foot.

These two areas withstand a great amount of pressure, especially during extended use. This repetitive motion can cause bruising and other issues with the bones and muscles of the feet. This invention will aid the drummer by greatly reducing pressure, therefore adding comfort, as well as, reducing the negative effects of barefoot drumming.

The Drum Pedal Cover invention is fastened to the drum pedal by any number of strap assemblies located on the pedal cover. The general usage employs 3 strap assemblies that are located near the perimeter of the drum pedal cover. The straps are composed of polypropylene or nylon fabric webbing. The webbing has been improved with hook and loop material (commonly referred to as Velcro) strips on either end of the webbing. These strips of hook and loop material are attached by means of sewing them onto each end of the webbing on alternating sides. This is considered a complete strap assembly. This allows each end of a strap assembly to be attached to the other by forming a circle shape. The completed strap assembly is woven through the two apertures on each side of the drum pedal cover, which enables the load to be evenly distributed while creating less stress on the edges of the foam to avoid tearing. The ends of each strap assembly wrap underneath the drum pedal and are joined by the hook and loop strips, binding the drum pedal cover in place during use.

The usage of the strap assembly as a method of attachment of the drum pedal cover to the drum pedal surface is important for many reasons. The strap assembly is a non-invasive approach for binding the drum pedal cover to the drum pedal surface. The use of straps as a binding method also allows for the drum pedal surface to remain in its original factory condition. Whereas the use of adhesives and glues to bind the invention to a drum pedal could hinder it's usefulness in the future, or possibly void a drum pedal's warranty. The removal of an item that has been adhesively placed onto a drum pedal could also damage the drum pedal cover itself. The usage of a strap assembly as a binding method also allows for additional conveniences. The straps allow for quick adjustment of the drum pedal covers. They also can also be removed to allow for cleaning, and in situations which hinder the user's ability to play barefooted. Situations like extreme cold, or other undesirable environments that lend themselves to require the use of footwear. The strap assembly also allows for the same product to be used on multiple drum pedals, since it can be easily removed.

BRIEF DESCRIPTION OF THE SEVERAL VIEWS OF THE DRAWING

FIG. 2 is a top view of the drum pedal cover without the strap assemblies, revealing the apertures, which the strap assembly will pass through;

DETAILED DESCRIPTION OF THE INVENTION

Figure 1:
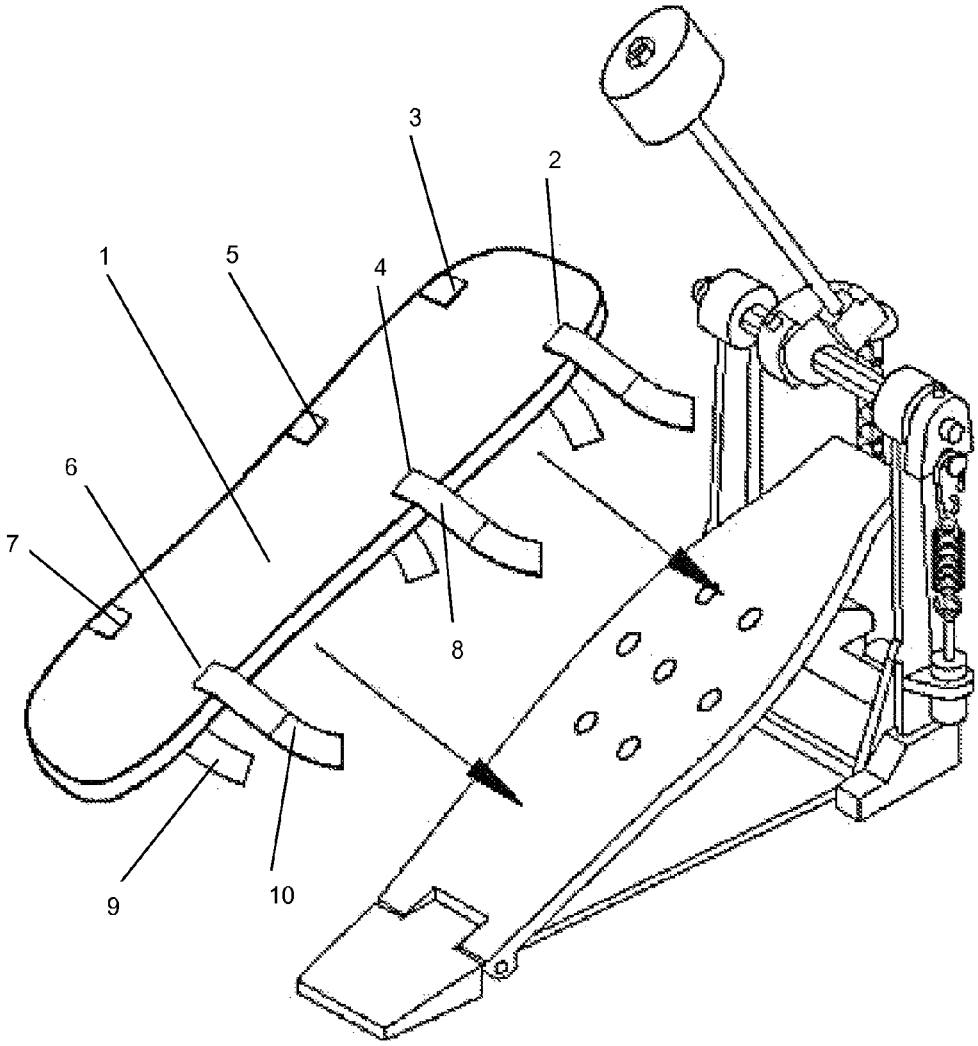
FIG. 1 is a perspective view of the invention hovering above a standard drum pedal and shows the direction in which it would be applied.

The invention is designed to be used when a drummer or percussionist prefers to use their bare feet to play the instrument(s). The invention uses any manner of foam material normally ½" to 2 inches in thickness, shaped into the outline of any Drum or Hi Hat Pedal. Depicted in FIG. 1, and FIG. 2, and FIG. 5; item 1 is the foam drum pedal cover. It consists of a single layer of dense foam/rubber material of varying thickness. The material being employed for the invention is commonly referred to as EPDM. EPDM is a closed-cell neoprene foam rubber that is commonly used in other industrial applications such as weather-stripping, and gaskets. Although this type of material is being used to manufacture this product currently, any type of similar material could be used, at any point in the future to achieve the desired result.

It is not the intention to limit this invention to the use of one type of material, if others with similar capabilities were to become available in the future. The EPDM foam that is being employed in the invention is graded based on its density. The density grades of this material ranges from SCE-41 to SCE-45; SCE-41 being the softest and SCE-45 the most firm. The preferred density grade for this application was SCE-43. The grade was chosen due to its exhibition of the proper; compression force deflection, resiliency, as well as pliability. However, this invention will not be limited to the use of this specific material and is meant to encompass all materials of similar properties that could be used, now or at future intervals, to improve the products' performance or to account for a lack of availability of materials in the future. Item 1 is die-cut from a sheet form of EPDM, into the general shape of an ambidextrous shoe sole. While this is the preferred method, there are many methods that could be employed to create to achieve the desired effect.

Figure 2:
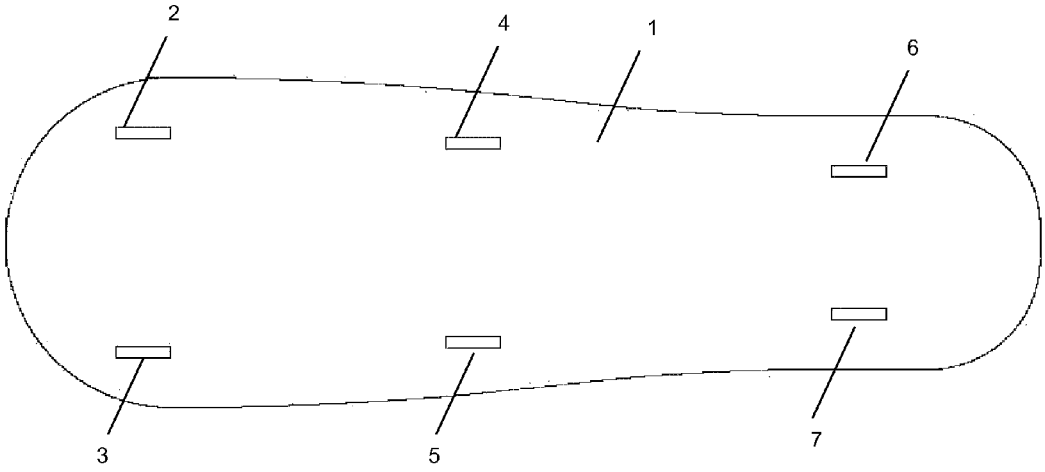

FIG. 2 shows: Items 1, 2, 3,4,5,6, and 7 and entail the items that are considered apertures in various locations on item 1. Items 2 and 3 are the top apertures, which will accept the strap assembly shown in FIG. 3 & FIG. 4, and fasten the top portion of the drum pedal cover to the drum pedal surface. Items 4 and 5 are the middle apertures, which will accept the strap assembly shown in FIG. 3 & FIG. 4, and fasten the middle portion of the drum pedal cover to the drum pedal surface. Items 6 and 7 are the bottom apertures, which will accept the strap assembly shown in FIG. 3 & FIG. 4, and will fasten the bottom portion of the drum pedal cover with the drum pedal surface. These are strategically-placed apertures, located on item 1 to provide a uniform location for placement of items 8,9,10 in FIG. 3 and FIG. 4.

Figure 3:
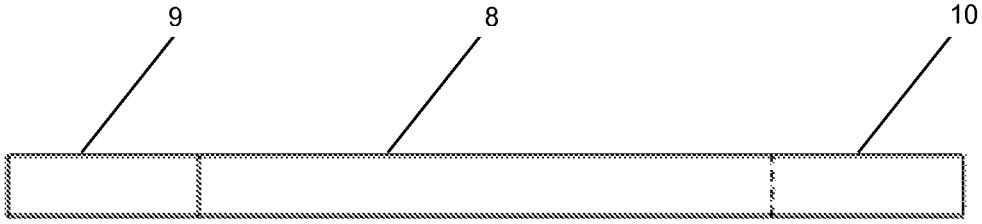
FIG. 3 is a top view of a strap assembly, revealing the hook and loop ends on alternating sides indicated by a dash line.

FIG. 3 shows a top view of the strap assembly. Item 8, the polypropylene strap is generally 10" in length, and ⅝" in width. However, the straps could vary in length and width, depending on availability of materials and the demands of the usage. Item 9 consists of the hook portion of the hook and loop material (also commonly referred to as Velcro). Item 9 is attached to item 8 by manner of sewing the materials together to the top side of item 8. Item 9 is, generally 2" in length and also ⅝" in width.

However, this item's length and width could vary depending on the availability of materials and demands of usage. Item 10 consists of the loop portion of the hook and loop material. Item 10 is attached to the bottom side of item 8 by the sewing of the two materials. This is indicated by the dash line in FIG. 3, showing item 10 on the underside of item 8. Item 10 is generally 2" in length and ⅝" in width. This item's length and width could also vary depending on the availability of materials and the demands of the usage.

Figure 4:
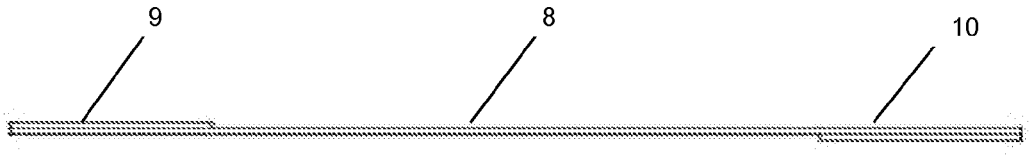
FIG. 4 is a side view of a strap assembly, which also reveals the hook and loop ends on alternating sides.

FIG. 4 shows a side view of items 8, 9, and 10, further, the strap assembly. This further reveals how items 9 and 10 are attached to item 8. Item 9 is sewed to item 8 and it is shown as the top side. Further, item 10 is sewed to the underside of item 8.

Figure 5:
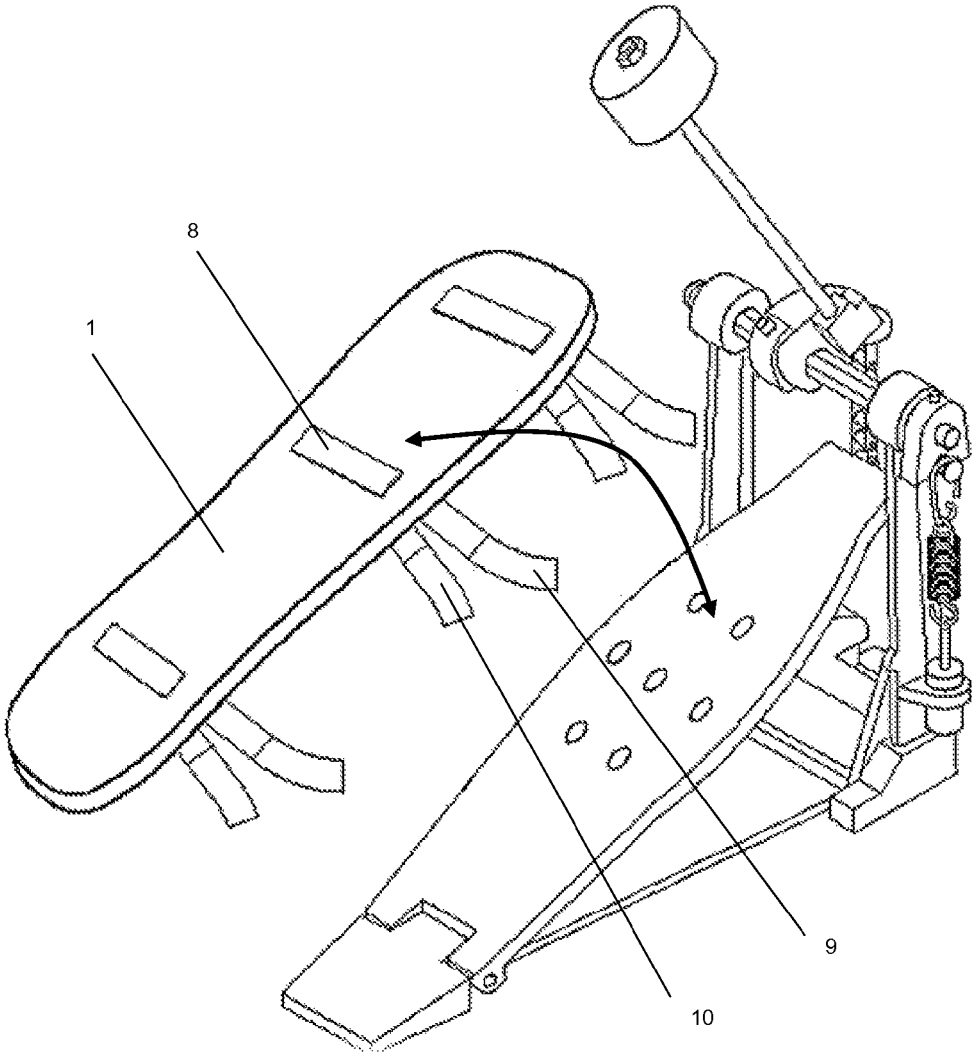
FIG. 5 is a bottom view of the drum pedal cover invention, which shows how the strap assemblies are woven through the apertures, as well as, the preferred method of mating the two surfaces, as indicated by the bold curved line.

FIG. 5 shows a bottom view of items 1, 8, 9, and 10, of the drum pedal cover invention. It further displays how item 8 is woven through the apertures depicted in FIG. 2. The drawing also shows the intended application of the drum pedal cover invention by the direction of the bold arrow. Items 8, 9, 10, the strap assembly, will then be joined on the underside of the pedal, holding it securely in place, while in use.

I claim:

1. A drum pedal cover consisting of a singular layer of flexible material covering the surface, or a major portion thereof, of a drum pedal; having 6 apertures located throughout the upper, middle and lower portions of the drum pedal cover. Wherein, is a structure of binding the drum pedal cover to a drum pedal surface through the use of a series of multiple strap assemblies woven throughout the upper, middle, and lower portions of the drum pedal cover, which are joined together on alternating sides by hook and loop material on either end of the individual strap assemblies.

* * * * *